US005858602A

United States Patent [19]

Yoshimura et al.

[11] Patent Number: 5,858,602

[45] Date of Patent: Jan. 12, 1999

[54] ENCAPSULATED TONER FOR HEAT-AND-PRESSURE FIXING AND METHOD FOR PRODUCING THE SAME

[75] Inventors: Kanji Yoshimura; Yukiya Sato, both of Wakayama, Japan

[73] Assignee: Kao Corporation, Tokyo, Japan

[21] Appl. No.: 939,229

[22] Filed: Sep. 29, 1997

[30] Foreign Application Priority Data

Sep. 30, 1996 [JP] Japan ..... 8-279939

[51] Int. Cl.[6] ..... G03G 9/093

[52] U.S. Cl. ..... 430/138

[58] Field of Search ..... 430/110, 109, 430/126, 138

[56] References Cited

U.S. PATENT DOCUMENTS

| | | | |
|---|---|---|---|
| 4,855,209 | 8/1989 | Martin et al. | 430/126 |
| 4,933,252 | 6/1990 | Nishikawa et al. | 430/109 |
| 5,529,876 | 6/1996 | Sasaki et al. | 430/137 |
| 5,712,074 | 1/1998 | Sato et al. | 430/110 |

OTHER PUBLICATIONS

Derwent Patent Abstract for JP–A–63–163469.

Derwent Patent Abstract for JP–A–3–189657.

Derwent Patent Abstract for JP–A–6–130713.

*Primary Examiner*—John Goodrow

*Attorney, Agent, or Firm*—Birch, Stewart, Kolasch & Birch, LLP

[57] ABSTRACT

A method for producing an encapsulated toner for heat-and-pressure fixing including the step of forming a heat-fusible core material containing at least a thermoplastic resin and a shell, the shell being formed so as to coat surfaces of the heat-fusible core material with an amorphous polyester by in situ polymerization. In this method, a pH of a suspension during polymerization is adjusted to a range of 9 to 13, and an acid value of the amorphous polyester is from 0.1 to 15 KOH mg/g.

3 Claims, No Drawings

ENCAPSULATED TONER FOR HEAT-AND-PRESSURE FIXING AND METHOD FOR PRODUCING THE SAME

BACKGROUND OF THE INVENTION

1. Field of the Invention

The present invention relates to an encapsulated toner for heat-and-pressure fixing used for development of electrostatic latent images in such techniques as electrophotography, electrostatic printing, and electrostatic recording, and a method for producing the above encapsulated toner.

2. Discussion of the Related Art

As described in U.S. Pat. Nos. 2,297,691 and 2,357,809 and other publications, conventional electrophotography comprises the steps of forming an electrostatic latent image by evenly charging a photoconductive insulating layer, subsequently exposing the layer to eliminate the charge on the exposed portion and visualizing the formed image by adhering colored charged fine powder, known as a toner, to the latent image (a developing process); transferring the obtained visible image to an image-receiving sheet, such as a transfer paper (a transfer process); and permanently fixing the transferred image by heating, pressure application or other appropriate means of fixing (a fixing process).

As indicated above, the toner must meet the requirements not only of the development process, but also of the transfer process and the fixing process.

Further, toners have to meet the requirement of environmental stability wherein toners do not undergo changes in such properties as triboelectric charges regardless of the serviceable environmental conditions of low-temperature, low-humidity conditions to high-temperature, high-humidity conditions, and it is also required that the toners have to be sufficiently charged both positively and negatively. However, when a polyester resin is used for the toner, since the polyester resin has a carboxyl group as a functional group, it is strongly negatively chargeable, thereby making it disadvantageous to make a positively chargeable toner. Moreover, the larger the content of the carboxyl group, the more susceptible to environmental changes, particularly in humidity conditions in the resulting toner.

Therefore, Japanese Patent Laid-Open Nos. 63-163469 and 03-189657 disclose that it is extremely effective to control the acid value to a low value in the polyester in order to achieve excellent environmental stability in a toner containing a polyester resin.

On the other hand, techniques for improving low-temperature fixing ability by using, as a toner, an encapsulated toner comprising a core material and a shell formed so as to coat the surfaces of the core material have been proposed.

Among such toners, those having a core material made of a low-melting wax which is easily plastically deformable, as described in U.S. Pat. No. 3,269,626 and Japanese Patent Examined Publication Nos. 46-15876, are poor in fixing strength, so that they can be used only in limited areas, although they can be fixed only by pressure. Further, in the case where toners having a liquid core material are used, when the shell strength is too low, the shell materials tend to break in the developer device and stain the inside thereof, thereby making it difficult to control the strength of the shell materials.

Therefore, as a toner for heat-and-pressure fixing, an encapsulated toner for heat roller fixing has been proposed, which comprises a core material made of a resin having a low glass transition temperature which serves to improve the fixing strength, though blocking at a high temperature may take place if used alone, and a shell made of a high-melting point resin wall which is formed by interfacial polymerization for the purpose of imparting a blocking resistance to the toner.

The encapsulated toners mentioned above including those disclosed in Japanese Patent Laid-Open No. 61-56352 and other encapsulated toners with additional improvements have been proposed (see Japanese Patent Laid-Open Nos. 58-205162, 58-205163, 63-128357, 63-128358, 63-128359, 63-128360, 63-128361, and 63-128362). However, since these toners are prepared by a spray drying method, a higher load to the equipment for the production thereof becomes necessary. In addition, they cannot fully exhibit the performance of the core material, because they have not come up with a solution for the problems in the shell material.

Therefore, an encapsulated toner using a compound having a thermal dissociation property as a shell material (Japanese Patent Laid-Open No. 4-212169) and an encapsulated toner using an amorphous polyester as a shell material have been proposed (Japanese Patent Laid-Open No. 6-130713). In cases of producing the encapsulated toners mentioned above, from the viewpoint of simplifying the production process and the production facilities, the above encapsulated toners are advantageously produced by a process comprising the steps of suspending polymerizable monomers in a dispersion medium, and forming a shell by interfacial polymerization or in situ polymerization.

However, particularly in the case where an amorphous polyester having too low an acid value, for instance, an acid value of 3 KOH mg/g or less, is used, the polyester is less likely to exudate to the surfaces of the liquid droplets during in situ polymerization, thereby resulting in poor storage stability of the toner.

An object of the present invention is to provide an encapsulated toner for heat-and-pressure fixing having excellent environmental stability and storage stability, and also having excellent positive triboelectric chargeability even when low-acid value polyesters are used.

Another object of the present invention is to provide a method for producing the above encapsulated toner.

These and other objects of the present invention will be apparent from the following description.

SUMMARY OF THE INVENTION

As a result of intense studies in view of the above objects, the present inventors have found that even when the low-acid value polyesters are used, which have been conventionally considered to be rather difficult to be used, the shell-forming material is unexpectedly easily exuded to the surfaces of the liquid droplets during in situ polymerization by adjusting the pH of the suspension to 9 to 13 in contrast to the pH conditions of about 8 or less in conventional in situ polymerization. The present invention has been completed based on these findings and upon further studies.

The present invention is concerned with the following:

(1) A method for producing an encapsulated toner for heat-and-pressure fixing comprising the step of forming a heat-fusible core material containing at least a thermoplastic resin and a shell, the shell being formed so as to coat surfaces of the heat-fusible core material with an amorphous polyester by in situ polymerization, wherein a pH of a suspension during polymerization is adjusted to a range of 9 to 13, and wherein an acid value of the amorphous polyester is from 0.1 to 15 KOH mg/g;

(2) The method described in item (1) above, wherein the acid value of the amorphous polyester is from 0.1 to 3 KOH mg/g;

(3) The method described in item (1) above, wherein in situ polymerization method comprises the steps of:

(a) dissolving a shell-forming resin comprising an amorphous polyester of which an acid value is from 0.1 to 15 KOH mg/g in a mixture comprising a core material-constituting monomer;

(b) dispersing the mixture obtained in step (a) in a dispersion medium to obtain a suspension, and adjusting a pH of the suspension to a range of 9 to 13, whereby the shell-forming resin is localized on the surface of droplets of the core-constituting material monomer to give a polymerizable composition; and (c) polymerizing the polymerizable composition in the suspension to form the core material, the shell coating the surface of the core material; and (4) An encapsulated toner for heat-and-pressure fixing comprising a heat-fusible core material containing at least a thermoplastic resin and a shell formed so as to coat surfaces of the heat-fusible core material with an amorphous polyester by in situ polymerization, wherein an acid value of the amorphous polyester is 0.1 to 3 KOH m/g.

DETAILED DESCRIPTION OF THE INVENTION

The method for producing an encapsulated toner for heat-and-pressure fixing of the present invention comprises the step of forming a heat-fusible core material containing at least a thermoplastic resin and a shell formed so as to coat surfaces of the heat-fusible core material with an amorphous polyester by in situ polymerization, wherein a pH of a suspension during polymerization is adjusted to a range of 9 to 13, and wherein an acid value of the amorphous polyester is from 0.1 to 15 KOH mg/g.

The shell-forming resins contained in the encapsulated toner of the present invention are not particularly limited, as long as they have higher hydrophilic properties than the thermoplastic resin used in the core material in the case of producing the toner by in situ method. Examples thereof include polyesters; polyesteramides; polyamides; polyureas; polymers of nitrogen-containing monomers, such as dimethylaminoethyl methacrylate and diethylaminoethyl methacrylate; copolymers of the above monomers and styrene or unsaturated carboxylic acid esters; polymers of unsaturated carboxylic acids, such as methacrylic acid and acrylic acid, unsaturated dibasic acids, or unsaturated dibasic acid anhydrides; and copolymers of the above monomers and styrenic monomers. Among the shell-forming resins, an amorphous polyester is suitably used as a main component thereof in the present invention, because the resulting toner has excellent low-temperature fixing ability and the like.

The acid values of the amorphous polyesters usable in the present invention are 0.1 (KOH mg/g) or more, preferably 0.5 (KOH mg/g) or more, more preferably 1.0 (KOH mg/g) or more from the viewpoint of storage stability, and the acid values are 15 (KOH mg/g) or less, preferably 10 (KOH mg/g) or less, more preferably 3.0 (KOH mg/g) or less from the viewpoints of environmental stability and positive triboelectric chargeability. Therefore, the acid values of the above amorphous polyesters are from 0.1 to 15 (KOH mg/g), preferably from 0.1 to 3.0 (KOH mg/g), more preferably from 1.0 to 3.0 (KOH mg/g). In the present invention, from the aspects of the environmental stability and the positive triboelectric chargeability, the acid values are preferably as low as possible. On the other hand, when the acid value is 3 (KOH mg/g) or less, since the storage stability of the resulting toner becomes poor in conventional method, the amorphous polyesters having low acid values cannot be used. In contrast, good storage stability of the resulting toner can be maintained by producing the toner in the method of the present invention. Accordingly, remarkable effects can be particularly noted for the amorphous polyesters having low acid values of 3 (KOH mg/g) or less as compared to those employing the conventional production methods. Here, the acid value is measured by the method according to JIS K0070.

The glass transition temperature of the amorphous polyester thus obtained is preferably 500° to 80° C., more preferably 550° to 75° C., from the viewpoints of the storage stability and the fixing ability of the resulting toner. In the present invention, the "glass transition temperature" used herein refers to the temperature of an intersection of the extension of the baseline of not more than the glass transition temperature and the tangential line showing the maximum inclination between the kickoff of the peak and the top thereof as determined using a differential scanning calorimeter ("DSC MODEL 210," manufactured by Seiko Instruments, Inc.), at a temperature rise rate of 10° C./min.

The amorphous polyester usable in the present invention can be preferably obtained by a condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher polycarboxylic acid monomers.

The amorphous polyester described above can be contained in an amount of usually 50 to 100% by weight, based on the total weight of the resins in the shell, and the other components which may be contained in the shell include polyamides, polyesteramides, and polyurea resins in an amount of 0 to 50% by weight.

Examples of the dihydric alcohol monomers include bisphenol A alkylene oxide adducts, such as polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, propylene adducts of bisphenol A, ethylene adducts of bisphenol A, hydrogenated bisphenol A, and other dihydric alcohol monomers.

Examples of the trihydric or higher polyhydric alcohol monomers include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohol monomers. Among the alcohol monomers, the trihydric alcohol monomers are preferably used.

In the present invention, these dihydric alcohol monomers and trihydric or higher polyhydric alcohol monomers may be used singly or in combination.

As for the acid components, examples of the dicarboxylic acid monomers include dicarboxylic acids, such as maleic acid, fumaric acid, citraconic acid, itaconic acid, glutaconic acid, phthalic acid, isophthalic acid, terephthalic acid, succinic acid, adipic acid, sebacic acid, azelaic acid, and malonic acid; alkyl- or alkenyl-substituted succinic acids, the alkyl group having 1 to 20 carbon atoms or the alkenyl group having 2 to 20 carbon atoms, such as n-dodecenylsuccinic acid, n-dodecylsuccinic acid, n-octylsuccinic acid, isooctenylsuccinic acid, and isooctylsuccinic acid, acid anhydrides thereof, lower alkyl esters thereof, and other dicarboxylic acid monomers.

Examples of the tricarboxylic or higher polycarboxylic acid monomers include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, Empol trimer acid, acid anhydrides thereof, lower alkyl esters thereof, and other tricarboxylic or higher polycarboxylic acid monomers. In the present invention, among these carboxylic acid components, a preference is given to the tricarboxylic acids or derivatives thereof.

In the present invention, these dicarboxylic acid monomers and tricarboxylic or higher polycarboxylic acid monomers may be used singly or in combination.

The method for producing an amorphous polyester in the present invention is not particularly limited, and the amorphous polyester can be produced by esterification or transesterification of the above monomers.

Here, "amorphous" refers to those which do not have a definite melting point. Here, a crystalline polyester is not used in the present invention. This is because the amount of energy required for fusion is large, and thereby the fixing ability of the toner becomes undesirably poor.

In the present invention, additives which may be suitably selected in amounts so as not to impair the function of the shell can be dispersed in the shell-forming resin. Here, various additives include conductive substances, charge control agents, wax components, pigments, particulate magnetic materials, and the like. These additives may be used in combination of two or more kinds, and they may be also dispersed in the core material.

The resins used as the main components of the heat-fusible core material in the encapsulated toner of the present invention include thermoplastic resins, such as polyester resins, polyester-polyamide resins, polyamide resins, and vinyl resins, with a preference given to the vinyl resins. The glass transition temperatures ascribed to the thermoplastic resin used as the main component of the heat-fusible core material mentioned above are preferably 100° to 50° C., more preferably 200° to 45° C., from the viewpoints of the storage stability and the fixing strength of the encapsulated toner.

Among the above-mentioned thermoplastic resins, examples of the monomers of the vinyl resins include styrene and styrene derivatives, such as styrene, o-methylstyrene, m-methylstyrene, p-methylstyrene, α-methylstyrene, p-ethylstyrene, 2,4-dimethylstyrene, p-chlorostyrene, and vinylnaphthalene; ethylenic unsaturated monoolefins, such as ethylene, propylene, butylene, and isobutylene; vinyl halides, such as vinyl chloride, vinyl bromide, vinyl fluoride; vinyl esters, such as vinyl acetate, vinyl propionate, vinyl butyrate, and vinyl caproate; ethylenic monocarboxylic acids and esters thereof, such as acrylic acid, methyl acrylate, ethyl acrylate, n-propyl acrylate, isopropyl acrylate, n-butyl acrylate, isobutyl acrylate, t-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate, and diethylaminoethyl methacrylate; substituted monomers of ethylenic monocarboxylic acids, such as acrylonitrile, methacrylonitrile, and acrylamide; ethylenic dicarboxylic acids and substituted monomers thereof, such as dimethyl maleate; vinyl ketones, such as vinyl methyl ketone; vinyl ethers, such as vinyl methyl ether; vinylidene halides, such as vinylidene chloride; and N-vinyl compounds, such as N-vinylpyrrole and N-vinylpyrrolidone.

Among the above core material resin components in the present invention, it is preferred that styrene or styrene derivatives is used in an amount of preferably 50 to 90% by weight to form the main structure of the resins, and that the ethylenic monocarboxylic acid or esters thereof is used in an amount of preferably 10 to 50% by weight in order to adjust the thermal properties, such as the softening point of the resins, because the glass transition temperature of the core material resin can be easily controlled.

A crosslinking agent may be added, if necessary, to the monomer composition. Examples of crosslinking agents added to monomer compositions constituting the core material resins include any of the generally known crosslinking agents, such as divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate, and diallyl phthalate. Among them, a preference is given to divinylbenzene and polyethylene glycol dimethacrylate. These crosslinking agents may be used alone or, if necessary, in a combination of two or more.

The amount of these crosslinking agents used is preferably 0.001 to 15% by weight, more preferably 0.1 to 10% by weight, based on the polymerizable monomers from the viewpoints of the heat fixing ability and the heat-and-pressure fixing ability of the resulting toner free from "offset phenomenon" wherein a part of the toner cannot be completely fixed on a paper but rather adheres to the surface of a heat roller, which in turn is transferred to a subsequent paper.

A graft or crosslinked polymer prepared by polymerizing the above monomers in the presence of an unsaturated polyester may be also used as the resin for the core material.

Examples of the polymerization initiators to be used in the production of the thermoplastic resin for the core material include azo and diazo polymerization initiators, such as 2,2'-azobis(2,4-dimethylvaleronitrile), 2,2'-azobisisobutyronitrile, 1,1'-azobis(cyclohexane-1-carbonitrile), and 2,2'-azobis-4-methoxy-2,4-dimethylvaleronitrile; and peroxide polymerization initiators, such as benzoyl peroxide, methyl ethyl ketone peroxide, isopropyl peroxycarbonate, cumene hydroperoxide, 2,4-dichlorobenzoyl peroxide, lauroyl peroxide, and dicumyl peroxide.

For the purposes of controlling the molecular weight or molecular weight distribution of the polymer or controlling the reaction time, two or more polymerization initiators may be used in combination. The amount of the polymerization initiator used is preferably 0.1 to 20 parts by weight, more preferably 1 to 10 parts by weight, based on 100 parts by weight of the polymerizable monomers.

Next, the method for production of the encapsulated toner for heat-and-pressure fixing of the present invention will be explained in detail below. The encapsulated toners for heat-and-pressure fixing of the present invention are suitably produced by in situ polymerization method from the viewpoint of simplicity in the production facilities and the production steps.

In the present invention, in situ polymerization method comprises the steps of:

(a) dissolving a shell-forming resin comprising an amorphous polyester of which an acid value is from 0.1 to 15 KOH mg/g in a mixture comprising a core material-constituting monomer;

(b) dispersing the mixture obtained in step (a) in a dispersion medium to obtain a suspension, and adjusting a pH of the suspension to a range of 9 to 13, whereby the shell-forming resin is localized on the surface of droplets of the core-constituting material monomer to give a polymerizable composition; and (c) polymerizing the polymerizable composition in the suspension to form the core material, the shell coating the surface of the core material.

In the method for production of the encapsulated toner of the present invention, the shell can be formed by utilizing the property that when a mixed solution comprising the core-constituting materials and the shell-forming material is dispersed in a dispersion medium, the shell-forming material localizes onto the surface of the oil droplets. Specifically, the separation of the core-constituting materials and the shell-forming material in the oil droplets of the mixed solution takes place due to the difference in the solubility indices, and the polymerization proceeds in this state to form core material resin and at the same time to form a shell with shell-forming resins, and thereby an encapsulated structure is formed. By this method, a shell is formed as a layer of shell-forming materials with a substantially uniform thickness, so that the triboelectric chargeability of the toner becomes uniform.

Incidentally, a general method of encapsulation by in situ polymerization is carried out by supplying monomers for shell-forming resins, polymerization initiators, etc. from either one of the inner phase or outer phase of the dispersed phase and forming a shell resin by polymerization to give an encapsulated structure (see *Microcapsule,* T. Kondo and N. Koishi, 1987, published by Sankyo Shuppan Kabushiki Kaisha). On the other hand, in in situ polymerization in the present invention, since the core material resin is formed in the inner portion of the shell resin by polymerizing monomers for the core material resins, polymerization initiators, and the like, the encapsulation mechanism in the present invention is somewhat different from that of the general encapsulation in in situ polymerization method. However, since the method of the present invention is similar to the general encapsulation by in situ polymerization in that the monomers are supplied only from the inner phase of the dispersed phase, the present method may be a sort of in situ polymerization in a broader sense.

In in situ polymerizaion mentioned above in the present invention, by adjusting the pH of the suspension during polymerization to a range of 9 to 13, preferably to a range of 10 to 12, even when an amorphous polyester having a low acid value of 3 KOH mg/g or less is used as mentioned above, the shell-forming materials are more easily exudated to the surfaces of the liquid droplets. When the pH of the suspension is 9 or more, notable effects can be obtained, and when the pH is 13 or less, the polymerization reaction favorably proceeds, thereby achieving good storage stability in the resulting toner.

In the present invention, the pH adjustment of the suspension during polymerization may be made by adjusting the dispersion medium usable for in situ polymerization to a given range prior to use. Alternatively, the pH adjustment may be made to a given range by adding a pH adjusting agent, such as aqueous sodium hydroxide, to the polymerizable composition dispersed in a dispersion medium.

Examples of the dispersion media include water, methanol, ethanol, propanol, butanol, ethylene glycol, glycerol, acetonitrile, acetone, isopropyl ether, tetrahydrofuran, and dioxane, among which water is preferably used as an essential component. These dispersion media can be used singly or in combination.

In the present invention, when the mixed solution comprising the core-constituting materials and the shell-forming materials is dispersed in a dispersion medium, a dispersion stabilizer is added into the dispersion medium in order to prevent aggregation and incorporation of the dispersed substances.

Examples of the dispersion stabilizers include gelatin, gelatin derivatives, polyvinyl alcohols, polystyrenesulfonic acids, hydroxymethylcellulose, hydroxyethylcellulose, hydroxypropylcellulose, sodium carboxymethylcellulose, sodium polyacrylates, sodium dodecylbenzenesulfonate, sodium tetradecyl sulfate, sodium pentadecyl sulfate, sodium octyl sulfate, sodium allyl alkyl polyethersulfonate, sodium oleate, sodium laurate, sodium caprate, sodium caprylate, sodium caproate, potassium stearate, calcium oleate, sodium 3,3-disulfonediphenylurea-4,4-diazobisamino-β-naphthol-6-sulfonate, o-carboxybenzeneazodimethylaniline, sodium 2,2,5,5-tetramethyltriphenylmethane-4,4-diazobis-β-naphtholdisulfonate, colloidal silica, alumina, tricalcium phosphate, ferrous hydroxide, titanium hydroxide, and aluminum hydroxide, with a preference given to tricalcium phosphate. These dispersion stabilizers may be used alone or in combination of two or more.

Also, in in situ polymerization described above in the present invention, by dispersing various additives in the shell-forming resin, a shell dispersed with various additives can be formed. According to this method, since the various additives are present in the shell-forming resin components in a dispersed state, not being present on the surfaces of the shell of the toner, problems of machine staining owing to the peeling off of the various additives from the shell surfaces upon the stirring in developer device are not likely to take place. Also, the actions of the various additive can be well exhibited.

The additives may be dispersed in the shell-forming resin usually by known methods. For instance, the additives may be melt-kneaded and dispersed by a twin-screw kneader, a Banbury mixer, a kneader, or the like, or the additives may be melt-blended and dispersed during the production process of the shell-forming resin.

In the method for the production of the present invention, the amount of the above shell-forming resin is preferably 3 to 50 parts by weight, more preferably 5 to 40 parts by weight, still more preferably 8 to 30 parts by weight, based on 100 parts by weight of the core material from the viewpoints of the storage stability of the obtained toner and the production stability.

In present invention, the encapsulated toner produced by the method explained above may be used as precursor particles, and seed polymerization may be further conducted to give an encapsulated toner for heat-and-pressure fixing. Therefore, in the present invention, there are two embodiments for the encapsulated toners of the present invention: One wherein the encapsulated toner is produced by in situ polymerization alone, and another wherein the encapsulated toner is produced by a combination of in situ polymerization (a first-step reaction) and seed polymerization (a second step reaction).

The seed polymerization in the present invention comprises the steps of adding at least a vinyl polymerizable monomer and an initiator for vinyl polymerization to an aqueous suspension of the encapsulated toner produced by the method explained above (hereinafter which may be simply referred to as "precursor particles") to absorb them into the precursor particles; and polymerizing the monomer components in the above precursor particles.

For instance, when the precursor particles are produced by in situ polymerization method described above, at least a vinyl polymerizable monomer and an initiator for vinyl polymerization are immediately added to the precursor particles in a suspending state, and the monomer and the initiator are absorbed into the precursor particles, so that seed polymerization takes place with the monomer components absorbed in the precursor particles. By this method, the production steps can be simplified. The vinyl polymerizable monomers, etc. which are added to be absorbed into the precursor particles may be used in a state of an aqueous emulsion.

The aqueous emulsion to be added can be obtained by emulsifying and dispersing the vinyl polymerizable monomer and the initiator for vinyl polymerization in water together with a dispersion stabilizer, which may further contain other additives, such as a crosslinking agent, an offset inhibitor and a charge control agent.

The vinyl polymerizable monomers used in the seed polymerization may be the same ones as those used for the production of the precursor particles. Also, the initiators for vinyl polymerization, the crosslinking agents and the dispersion stabilizers may also be the same ones as those used for the production of the precursor particles. The amount of the crosslinking agent used in the seed polymerization is preferably 0.001 to 15% by weight, more preferably 0.1 to 10% by weight, based on the vinyl polymerizable monomers for similar reasons for the crosslinking agents used in the first-step reaction.

In order to further improve the storage stability of the toner, hydrophilic shell-forming materials, such as the amorphous polyester described above, may be added to the aqueous emulsion. In this case, the amount of the shell-forming material added is preferably 1 to 20 parts by weight, more preferably 3 to 15 parts by weight, based on 100 parts by weight of the core material. Also, in the present invention, the various additives mentioned above may be dispersed in the shell-forming resins in advance, and in this case, the additives may be similarly selected from those listed above.

Further, the hydrophilic shell materials other than the amorphous polyesters including vinyl resins having hydrophilic functional groups, such as carboxyl group, acid anhydride group, hydroxyl group, amino group, and ammonium ion, amorphous polyesteramide resins, amorphous polyamide resins, and epoxy resins may be also used.

The aqueous emulsion described above can be prepared by uniformly dispersing the mixture using such devices as an ultrasonic vibrator.

Also, the acid value of the amorphous polyester usable in seed polymerization is preferably 0.1 to 15 KOH mg/g, more preferably 0.1 to 3 KOH mg/g for similar reasons given in the first-step reaction. Here, the acid value is measured by the method according to JIS K0070.

The amount of the aqueous emulsion added is adjusted so that the amount of the vinyl polymerizable monomer used is 10 to 200 parts by weight, based on 100 parts by weight of the precursor particles from the viewpoints of the fixing ability of the resulting toner and uniform absorption of the monomer components in the precursor particles.

By adding the aqueous emulsion thereto, the vinyl polymerizable monomer is absorbed into the precursor particles so that the swelling of the precursor particles takes place. In the seed polymerization reaction, the monomer components in the precursor particles are polymerized in the above state. This polymerization may be referred to as "seed polymerization," wherein the precursor particles are used as seed particles.

As explained above, the following features are improved when compared with the case where the encapsulated toner is produced solely by in situ polymerization method.

Specifically, the encapsulated toner produced by in situ polymerization method has more excellent low-temperature fixing ability and storage stability than conventional toners, and by further carrying out the seed polymerization method, a shell is formed more uniformly by the principle of surface science, thereby achieving a further excellent storage stability. Also, since the polymerizable monomer in the core material can be polymerized in two steps, namely, in situ polymerization reaction and the seed polymerization reaction, the molecular weight of the thermoplastic resin in the core material can be easily controlled by using a suitable amount of the crosslinking agent, thereby making the low-temperature fixing ability and the offset resistance more excellent. In particular, a toner suitable not only for a high-speed fixing but also for a low-speed fixing can be produced.

Although the particle size of the encapsulated toner produced by the method described above is not particularly limitative, the average particle size is preferably 3 to 30 $\mu$m. The thickness of the shell of the encapsulated toner is preferably 0.01 to 1 $\mu$m from the viewpoints of the blocking resistance and the heat fusibility of the resulting toner.

In the encapsulated toner of the present invention, a free flowing agent, or a cleanability improver may be used, if necessary. Examples of the free flowing agents include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide and silicon nitride, with a preference given to finely powdered silica.

The cleanability improvers include fine powders of metal salts of higher fatty acids typically exemplified by zinc stearate or fluorocarbon polymers.

Further, for the purpose of controlling the developability of the encapsulated toner, finely powdered polymers of methyl methacrylate or butyl methacrylate may be added.

Furthermore, for the purpose of adjusting toning and electric resistance, a small amount of carbon black may be used. The carbon blacks may be those of conventionally known ones, including various kinds, such as furnace black, channel black, and acetylene black.

The encapsulated toner for heat-and-pressure fixing of the present invention is prepared by the method of the present invention described above by using an amorphous polyester having an acid value of 0.1 to 3 KOH m/g, and the encapsulated toner comprises a heat-fusible core material containing at least a thermoplastic resin and a shell formed so as to coat surfaces of the heat-fusible core material with an amorphous polyester by in situ polymerization.

When the encapsulated toner of the present invention contains particulate magnetic materials, it can be used alone as a developer. Alternatively, when the encapsulated toner does not contain any particulate magnetic material, it may be used as a non-magnetic one-component developer or as a two-component developer prepared by mixing the toner with a carrier. Although the carrier is not particularly limitative, examples thereof include iron powder, ferrite, glass beads, those of above with resin coatings, and resin carriers in which magnetite fine powders or ferrite fine powders are blended into the resins. The mixing ratio of the toner to the carrier is preferably 0.5 to 20% by weight. The particle size of the carrier is preferably 15 to 500 $\mu$m.

When the encapsulated toner of the present invention is fixed on a recording medium, such as paper, by heat and pressure, an excellent fixing strength is attained. As for the heat-and-pressure fixing process to be suitably used in the fixing of the toner of the present invention, any one may be used as long as both heat and pressure are utilized. Examples of the fixing processes which can be suitably used in the present invention include a known heat roller fixing process; a fixing process as disclosed in Japanese Patent Laid-Open No. 2-190870 in which visible images formed on a recording medium in an unfixed state are fixed by heating and fusing the visible images through the heat-resistant sheet with a heating means, comprising a heating portion and a heat-resistant sheet, thereby fixing the visible images onto the recording medium; and a heat-and-pressure process as disclosed in Japanese Patent Laid-Open No. 2-162356 in which the clear visible images are fixed on a recording medium by using a heating element fixed to a support and a pressing member arranged opposite to the heating element and being pressed so as to bring the recording medium in close contact with the heating element through a film.

Even in the case where low-acid value polyester is used, the present invention makes it possible to provide an encapsulated toner for heat-and-pressure fixing having excellent environmental stability and storage stability as well as excellent positive chargeability.

EXAMPLES

The present invention will be explained in detail by means of the following working examples, without intending to limit the scope of the present invention thereto.

Preparation Example 1 of Resin A

A two-liter four-necked glass flask was charged with 180 g of propylene oxide adduct of bisphenol A, 505 g of ethylene oxide adduct of bisphenol A, and 320 g of terephthalic acid, and a thermometer, a stainless stirring rod, a reflux condenser, and a nitrogen inlet tube were attached to the glass flask. The contents were heated to 220° C. in a mantle heater to carry out condensation polymerization.

The degree of polymerization was monitored from a softening point measured by the method according to ASTM E 28-67, and the reaction was terminated when the softening point reached 108° C. This resin is referred to as "Resin A."

Resin A had a glass transition temperature measured by differential scanning calorimeter ("DSC Model 210," manufactured by Seiko Instruments, Inc.) of 68° C. Also, the acid value measured according to JIS K0070 was 2 KOH mg/g.

Preparation Example 2 of Resin B

A two-liter four-necked glass flask was charged with 550 g of propylene oxide adduct of bisphenol A, 180 g of ethylene oxide adduct of bisphenol A, 337 g of terephthalic acid, and 8.0 g of trimellitic acid anhydride, and a thermometer, a stainless stirring rod, a reflux condenser, and a nitrogen inlet tube were attached to the glass flask. The contents were heated to 220° C. in a mantle heater to carry out condensation polymerization.

The degree of polymerization was monitored from a softening point measured by the method according to ASTM E 28-67, and the reaction was terminated when the softening point reached 118° C. This resin is referred to as "Resin B."

Resin B had a glass transition temperature measured by differential scanning calorimeter ("DSC Model 210," manufactured by Seiko Instruments, Inc.) of 72° C. Also, the acid value measured according to JIS K0070 was 8 KOH mg/g.

Preparation Example 3 of Resin C

A two-liter four-necked glass flask was charged with 390 g of propylene oxide adduct of bisphenol A, 320 g of ethylene oxide adduct of bisphenol A, 270 g of terephthalic acid, and 80 g of trimellitic acid anhydride, and a thermometer, a stainless stirring rod, a reflux condenser, and a nitrogen inlet tube were attached to the glass flask. The contents were heated to 220° C. in a mantle heater to carry out condensation polymerization.

The degree of polymerization was monitored from a softening point measured by the method according to ASTM E 28-67, and the reaction was terminated when the softening point reached 121° C. This resin is referred to as "Resin C."

Resin C had a glass transition temperature measured by differential scanning calorimeter ("DSC Model 210," manufactured by Seiko Instruments, Inc.) of 69° C. Also, the acid value measured according to JIS K0070 was 16 KOH mg/g.

Example 1

20 parts by weight of Resin A, 1.0 part by weight of BONTRON N-07 (manufactured by Orient Chemical Co., Ltd.), and 3.5 parts by weight of 2,2'-azobisisobutyronitrile were added to 69.0 parts by weight of styrene, 31.0 parts by weight of 2-ethylhexyl acrylate, 0.8 parts by weight of divinylbenzene, and 7.0 parts by weight of carbon black "#44" (manufactured by Mitsubishi Kasei Corporation). The obtained mixture was introduced into an attritor (Model MA-01SC, manufactured by Mitsui Miike Kakoki) and dispersed at 10° C. for 5 hours to give a polymerizable composition.

Next, 240 g of the above polymerizable composition was added to 560 g of a 4% by weight aqueous colloidal solution of tricalcium phosphate which was previously prepared in a two-liter separable glass flask. The obtained mixture was emulsified and dispersed with "T.K. HOMO MIXER, Model M" (manufactured by Tokushu Kika Kogyo) at 15° C. and a rotational speed of 12000 rpm for 5 minutes to prepare a suspension. A 10% by weight aqueous sodium hydroxide was added dropwise to the above suspension to adjust the pH of the suspension to 9.5.

Next, a four-necked glass cap was set on the flask, and a reflux condenser, a thermometer, a nitrogen inlet tube and a stainless steel stirring rod were attached thereto. The flask was placed in an electric mantle heater. Thereafter, the ingredients were heated to 85° C. and reacted at 85° C. for 10 hours in a nitrogen gas stream.

After cooling the reaction product, the dispersion medium was dissolved into 10% by weight-aqueous hydrochloric acid. The resulting product was filtered, and the obtained solid was washed with water, and air-dried, followed by drying under a reduced pressure of 20 mmHg at 35° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) were added and mixed to give an encapsulated toner according to the present invention. This toner is referred to as "Toner 1." The glass transition temperature ascribed to the resin contained in the core material was 30.2° C., and the softening point of Toner 1 determined by a flow tester was 125.5° C.

Example 2

Similar procedures as in Example 1 were carried out to give a suspension. Thereafter, a 10% by weight aqueous sodium hydroxide was added dropwise to adjust the pH of the suspension to 12. Subsequently, similar procedures as in Example 1 were carried out to allow the reaction of the ingredients, to give Toner 2 having a glass transition temperature of 30.7° C. and a softening point of 122.1° C.

Example 3

Similar procedures as in Example 1 were carried out except for changing Resin A to Resin B, to give a suspension. Thereafter, a 10% by weight aqueous sodium hydroxide was added dropwise to adjust the pH of the suspension to 10.5. Subsequently, similar procedures as in Example 1 were carried out to allow the reaction of the ingredients, to give Toner 3 having a glass transition temperature of 31.0° C. and a softening point of 120.9° C.

Comparative Example 1

Similar procedures as in Example 1 were carried out to give a suspension, whose pH without adding the 10% by weight aqueous sodium hydroxide was found to be 8.2. Thereafter, similar procedures as in Example 1 were carried out to allow the reaction of the ingredients, to give Comparative Toner 1 having a glass transition temperature of 30.5° C. and a softening point of 125.3° C.

Comparative Example 2

Similar procedures as in Example 1 were carried out to give a suspension. Thereafter, a 10% by weight aqueous sodium hydroxide was added dropwise to adjust the pH of the suspension to 13.5. Subsequently, similar procedures as in Example 1 were carried out to allow the reaction of the ingredients, to give Comparative Toner 2 having a glass transition temperature of 29.2° C. and a softening point of 119.5° C.

Comparative Example 3

Similar procedures as in Example 1 were carried out except for changing Resin A to Resin C to give a suspension. Thereafter, a 10% by weight aqueous sodium hydroxide was added dropwise to adjust the pH of the suspension to 10.5. Subsequently, similar procedures as in Example 1 were carried out to allow the reaction of the ingredients, to give Comparative Toner 3 having a glass transition temperature of 29.8° C. and a softening point of 123.1° C.

Test Example 1

A developer was prepared by charging a polyethylene container with 6 parts by weight of each of the toners prepared in Examples and Comparative Examples with 94 parts by weight of spherical ferrite powder coated with styrene-methyl methacrylate resin, the ferrite powder having a granularity of 250 to 400 mesh, and rotatably mixing the entire container on a roller at a rotational speed of 150 rpm for 20 minutes. The triboelectric charges under high-temperature, high-humidity conditions (35° C., relative humidity 85%), the image quality, and the toner stains within the machine of the resulting developers were evaluated by conducting continuous copying with a modified apparatus of a commercially available copy machine ("FT-2700," manufactured by Ricoh). The results are shown in Table 1.

TABLE 1

| | Triboelectric Charges at Start (μC/g) | Triboelectric Charges after Printing 10,000 Sheets (μC/g) | Image Quality (Background) | Toner Stains Within Machine |
|---|---|---|---|---|
| Toner 1 | 22.1 | 21.5 | Excellent | None |
| Toner 2 | 21.8 | 22.6 | Excellent | None |
| Toner 3 | 19.8 | 17.5 | Excellent | None |
| Comparative Toner 1 | 22.3 | 4.2 | Generated after copying 1000 sheets | Numerous |
| Comparative Toner 2 | 21.3 | 3.8 | Generated after copying 1000 sheets | Numerous |
| Comparative Toner 3 | 17.4 | 12.2 | Generated after copying 5000 sheets | Slightly Numerous |

Test Example 2

The blocking resistance of each of the toners prepared in Examples and Comparative Examples, which were the same ones used in Test Example 1, was evaluated by the cohesiveness after allowing the toners to stand for twenty-four hours under the conditions of a temperature of 50° C. and a relative humidity of 40%. The results are shown in Table 2.

Here, the cohesiveness of toners was evaluated by the following method.

Cohesiveness

Using "POWDER TESTER" (manufactured by Hosokawa Micron Co.), different-size sieves are arranged such that a 250 μm-sieve is at top, a 149 μm-sieve is at intermediary, and a 74 μm-sieve is at bottom, each sieve having a diameter of 70 mm. Each 2 g sample of toners after being subjected to the blocking resistance test described above is gently placed on a 250 μm sieve without allowing the sample to fall off the sieve. The set of sieves are vibrated with an amplitude of 1 mm for one minute, and the weight percentages of the toners remaining on each sieve are obtained. The cohesiveness is defined as a sum of values (a), (b), and (c) calculated by the following equations:

(a)=(the weight % of the toner remaining×1, on a 250 μm mesh-sieve)

(b)=(the weight % of the toner remaining×0.6, on a 149 μm mesh-sieve)

(c)=(the weight % of the toner remaining×0.2, on a 74 μm mesh-sieve)

TABLE 2

| | Gross Examination Evaluation | Cohesiveness (%) |
|---|---|---|
| Toner 1 | Undetected | 7.8 |
| Toner 2 | Undetected | 8.6 |
| Toner 3 | Undetected | 8.2 |
| Comparative Toner 1 | Detected | 36.2 |
| Comparative Toner 2 | Detected | 39.8 |
| Comparative Toner 3 | Undetected | 8.1 |

As is clear from Tables 1 and 2, Toners 1 and 2 are sufficiently positively charged, and their environmental properties are excellent, so that they have excellent blocking resistance. Also, Toner 3 has excellent image quality and free from toner stains within the machine, though, when compared with those of Toners 1 and 2, Toner 3 has a slightly lower positive chargeability, and the level of the triboelectric charges in Toner 3 after printing 10,000 sheets is slightly lowered. Thus, although Toner 3 has slightly impaired environmental properties, it is durable for practical use.

By contrast, in Comparative Toner 1, a shell comprising an amorphous polyester is not formed and the resulting toner has poor blocking resistance, which leads to a drastic decrease in the level of the triboelectric charges after printing 10,000 sheets owing to the toner spent to the carrier. Further, much background is caused, and toner stains within the machine are also caused. In Comparative Toner 2, although a shell comprising an amorphous polyester is formed, the polymerization degree of the toner is low, and the blocking resistance of the toner is poor, so that much toner spent is caused, thereby generating background and toner stains within the machine. In Comparative Example 3, since the acid value of the amorphous polyester is high, the level of the triboelectric charges is low from the start, so that its environmental properties are highly likely to be impaired. Therefore, the level of triboelectric charges after printing is further lowered, thereby generating background and toner stains within the machine.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing an encapsulated toner for heat-and-pressure fixing comprising the step of forming a heat-fusible core material containing at least a thermoplastic resin and a shell, said shell being formed so as to coat surfaces of the heat-fusible core material with an amorphous polyester by in situ polymerization, wherein a pH of a suspension during polymerization is adjusted to a range of 9 to 13, and wherein an acid value of the amorphous polyester is from 0.1 to 3 KOH mg/g.

2. The method according to claim 1, wherein in situ polymerization method comprises the steps of:

(a) dissolving a shell-forming resin comprising an amorphous polyester of which an acid value is from 0.1 to 15 KOH mg/g in a mixture comprising a core material-constituting monomer;

(b) dispersing the mixture obtained in step (a) in a dispersion medium to obtain a suspension, and adjusting a pH of the suspension to a range of 9 to 13, whereby the shell-forming resin is localized on the surface of droplets of the core-constituting material monomer to give a polymerizable composition; and (c) polymerizing the polymerizable composition in the suspension to form the core material, the shell coating the surface of the core material.

3. An encapsulated toner for heat-and-pressure fixing comprising a heat-fusible core material containing at least a thermoplastic resin and a shell formed so as to coat surfaces of the heat-fusible core material with an amorphous polyester by in situ polymerization, wherein an acid value of the amorphous polyester is 0.1 to 3 KOH m/g.

* * * * *